US006363876B1

(12) United States Patent
Blake

(10) Patent No.: US 6,363,876 B1
(45) Date of Patent: Apr. 2, 2002

(54) DEVICE FOR COUPLING A BOAT TO A MOORING

(76) Inventor: Albert C. Blake, P.O. Box 2038, Mt. Sunapee, NH (US) 03255

( * ) Notice: Subject to any disclaimer, the term of this patent is extended or adjusted under 35 U.S.C. 154(b) by 0 days.

(21) Appl. No.: 09/729,436

(22) Filed: Dec. 4, 2000

(51) Int. Cl.[7] ..... B63B 21/00

(52) U.S. Cl. ..... 114/230.1; 114/221 R; 114/230.3; 294/26; 294/19.1

(58) Field of Search ..... 114/221 R, 230.1, 114/230.13, 230.14, 230.15, 230.2, 230.24, 230.3; 294/26, 19.1

(56) References Cited

U.S. PATENT DOCUMENTS

| | | | | | |
|---|---|---|---|---|---|
| 2,347,718 | A | * | 5/1944 | Terry | 294/19.1 |
| 2,550,770 | A | * | 5/1951 | Calemmo | 114/230.15 |
| 2,730,985 | A | * | 1/1956 | Wingate | 294/19.1 |
| 3,167,346 | A | * | 1/1965 | Miller | 294/82.34 |
| 3,840,927 | A | * | 10/1974 | Reid, Jr. | 441/5 |
| 3,861,731 | A | * | 1/1975 | Young | 114/221 R |
| 3,993,013 | A | * | 11/1976 | Nunziato et al. | 114/221 R |
| 4,193,627 | A | * | 3/1980 | Cranston et al. | 294/82.19 |
| 4,195,872 | A | * | 4/1980 | Skaalen et al. | 294/82.19 |
| 4,751,892 | A | * | 6/1988 | Sechel et al. | 114/221 R |
| 5,192,104 | A | * | 3/1993 | Lin | 294/19.1 |
| 5,538,303 | A | * | 7/1996 | Dunham | 294/82.31 |
| 5,704,668 | A | * | 1/1998 | Ferrato | 294/19.1 |
| 5,967,575 | A | * | 10/1999 | Blake | 294/19.1 |

FOREIGN PATENT DOCUMENTS

| | | | | |
|---|---|---|---|---|
| FR | 2505433 | * | 11/1982 | 114/230.2 |
| GB | 250367 | * | 4/1926 | 114/230.2 |
| GB | 2209146 | * | 5/1989 | 114/230.1 |
| NL | 7512975 | * | 5/1977 | 114/230.1 |
| WO | WO-092/002406 | * | 2/1992 | 114/230.23 |

* cited by examiner

*Primary Examiner*—S. Joseph Morano
*Assistant Examiner*—Ajay Vasudeva
(74) *Attorney, Agent, or Firm*—Davis & Bujold, P.L.L.C.

(57) ABSTRACT

A device for coupling a boat to a boat mooring. The device comprises an elongate shaft having a hook member at one end thereof and an eyelet at the other end thereof. The hook has a pivotable latch for facilitating coupling and decoupling of the hook member to one of a boat eyelet and a mooring eyelet. The eyelet of the device is coupled to the eyelet of the mooring so that when the hook member of the device is coupled to the boat eyelet, the boat is coupled to the mooring and when use of the boat is desired, the hook member is released from the boat eyelet and coupled to the mooring eyelet to retain the device at the mooring and allow use of the boat and facilitate the attachment of the device to the boat eyelet when the boating activity ceases.

20 Claims, 5 Drawing Sheets

DEVICE FOR COUPLING A BOAT TO A MOORING

FIELD OF THE INVENTION

The present invention relates to a device for releasably coupling and decoupling a boat to a mooring with the device preferably being manufactured from stainless steel or some other corrosion resistant metal.

BACKGROUND OF THE INVENTION

There are a variety of known devices which assist a user with either hooking a conventional hook to a boat mooring or some other device or object as well as facilitating unhooking of the hook from a boat mooring or some other desired object. However, all the known prior art devices suffer from a number of associated drawbacks. In particular, the devices do not allow a latch member of the hook to be readily actuated by the device while, at the same time, facilitating movement of the hook for the task of coupling and decoupling from a desired object in a reliable manner.

SUMMARY OF THE INVENTION

Wherefore, it is an object of the present invention to overcome the above mentioned shortcomings and drawbacks associated with the prior art boat coupling devices.

It is another object of the present invention to provide a device, with a hook, which facilitates easy coupling and decoupling of a boat to a boat mooring.

Yet another object of the present invention is to provide a device which is manufactured from stainless steel, brass, aluminum or some other durable yet corrosion resistant material to facilitate use in water and salt water environments.

A still further object of the present invention is to provide a device which allows a user to easily and securely couple and decouple the device, according to the present invention, to an eyelet secured to a boat typically at the forward most portion of the bow of the boat slightly above the water line.

Another object of the present invention is to provide an actuation mechanism to facilitate remote operation of a pivotable latch of the device to facilitate relatively easy coupling and decoupling of the hook member of the device to and from either a boat eyelet, secured to the bow of the boat, or an mooring eyelet coupled to top portion of a mooring.

The present invention relates to a device for coupling a boat to a mooring, the device comprising an elongate shaft having a first end and an opposed second end, the first end of the shaft having a coupling mechanism for coupling the device to a mooring, the second end of the shaft supporting a hook member have a pivotable latch member, and the pivotable latch member being normally biased into a closed position; and an actuating mechanism having an actuator located adjacent the coupling mechanism and being coupled to the pivotable latch member for biasing the pivotable latch member into an open position, when the actuating mechanism is operated, to facilitate one of coupling and uncoupling of the hook member from a desired component.

The present invention also relates to a boat mooring for a boat, the boat mooring comprising: a device for coupling a boat to the boat mooring, the device comprising an elongate shaft having a first end and an opposed second end, the first end of the shaft having a coupling mechanism for coupling the device to the boat mooring, the second end of the shaft supporting a hook member have a pivotable latch member, and the pivotable latch member being normally biased into a closed position; and an actuating mechanism having an actuator located adjacent the coupling mechanism and being coupled to the pivotable latch member for biasing the pivotable latch member into an open position, when the actuating mechanism is operated, to facilitate one of coupling and uncoupling of the hook member from a desired component; a weight for engagement with a bottom of a body of water; a floatable mooring for marking a location of the boat mooring; a second flexible linkage for interconnecting the floatable mooring with the weight; and a first flexible linkage interconnecting the floatable mooring with the coupling member of the device.

BRIEF DESCRIPTION OF THE DRAWINGS

The invention will now be described, by way of example, with reference to the accompanying drawings in which.

DESCRIPTION OF THE PREFERRED EMBODIMENTS

Figure 1:
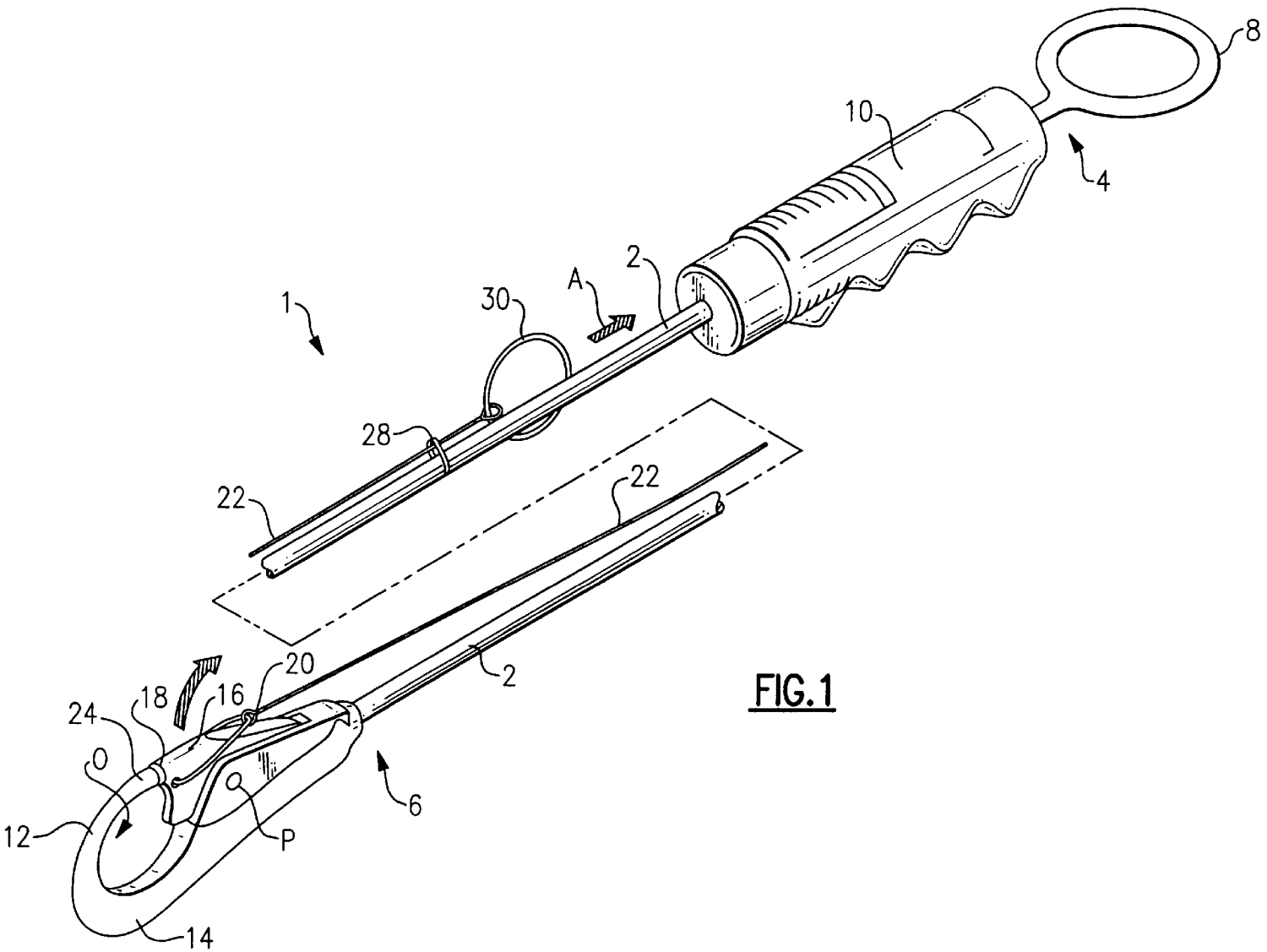
FIG. 1 is a diagrammatic prospective view showing a first embodiment of the device according to the present invention.

Turning first to FIG. 1, a detail description concerning the various components of a first embodiment of the present invention will now be provided. As can be seen in this Figure, the device 1 generally comprises an elongate shaft 2, preferably manufactured from a solid piece of stainless steel, brass, or some other corrosion resistant material. The shaft 2 has an outer diameter of at least ⅛ of an inch, more preferably between about ⅜ to about ½ of an inch or so. The elongate shaft 2 has a first end 4 and an opposed second end 6. The first end 4 supports a coupling member, such as an eyelet or continuous loop member 8. The eyelet or continuous loop member 8 is permanently attached to the first end 4 by welding, soldering or in some other conventional fashion so as to become integral with that end of the shaft 2. A conventional plastic hand grip 10 is preferably positioned adjacent the eyelet or continuous loop member 8 and the hand grip 10 is provided to facilitate manipulation of the device 1, as will be described below in further detail, by an end user.

Figure 5:
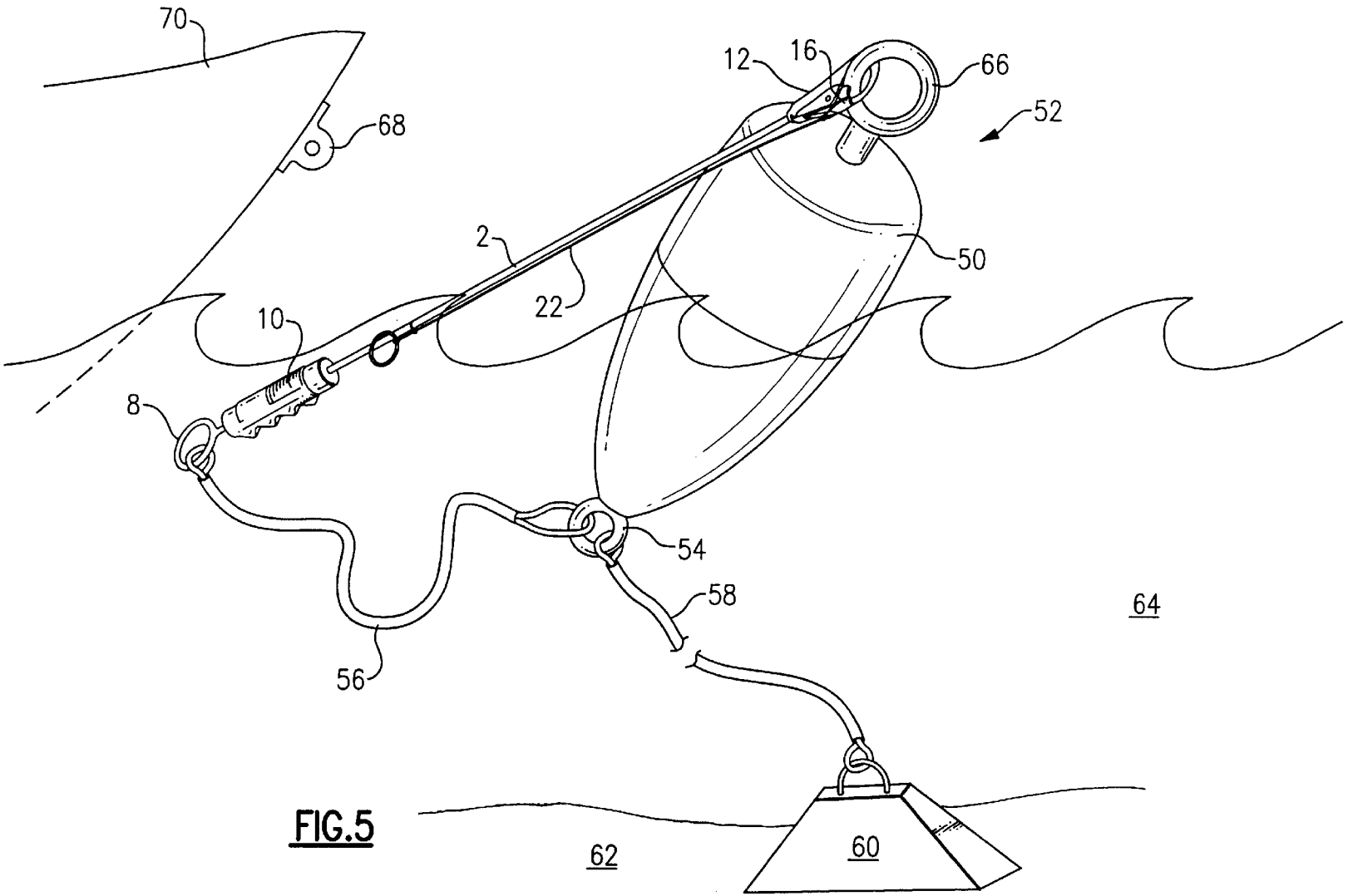
FIG. 5 is a diagrammatic view showing the device, according to the present invention, in use for releasably securing a boat to a mooring.

The opposed second end 6 of the elongate shaft 2 supports a hook member 12 for releasably engaging a desired "eyelet" or "continuous loop" component 66 (see FIG. 5, for example). The hook member 12 comprises a generally C-shaped hook base 14 defining a small entrance leading to an O shaped opening. The entrance is provided with a closure, such as a pivotable latch 16 rotatably attached to the hook base 14 and pivotable about pivot P. The pivotable latch 16 is biased by a spring (not shown in detail) into a normally closed position. The spring is housed internally within the hook member 12 and may be either a tension spring or a compression spring, depending upon its location and orientation with respect to the pivot P, to achieve the desired normally closing biased rotation of the pivotable latch 16. A free end portion 18 of the pivotable latch 16, when in the normally closed spring biased position, extends substantially across the entrance to engage a free end portion 24 and closed the C-shaped hook base 14. The free end portion 18 of the pivotable latch 16, in this embodiment, is spring biased toward and rotatable away from the free end portion 24, i.e. biased clockwise as can be seen in FIG. 1.

A first end 20 of an actuation wire 22 is coupled to or adjacent the free end portion 18 of the pivotable latch 16, via a bore in the pivotable latch 16, to facilitate biasing the free end portion 18 out of engagement with the free end portion 24 of the C-shaped hook base 14 to clear or "open" the entrance and facilitate the attachment or detachment of the hook member 12 to a desired component, e.g. an eyelet, a continuous loop member or an eye hook supported on either a bow of a boat or a boat mooring. An opposed second end 26 of the actuation wire 22 is attached, in a conventional manner, to a pull ring 30. The actuation wire passes through at least one and possibly a plurality of a guiding eyelets 28 spaced along the shaft 2. It is to be appreciated that only one guiding eyelet 28 is required and such guiding eyelet should be located near the hand grip 10, as can be seen in FIG. 1, so that the pull ring 30 is located adjacent the hand grip 10 and is positioned to be readily grasped and controlled by one or more fingers of a user's hand when grasping the hand grip 10. If the user tugs or pulls on the ring 30 in the direction of arrow A—toward the hand grip 10—the generated force is conveyed by the actuation wire 22 to the pivotable latch 16 to bias the free end 18 of the pivotable latch member 16 outwardly away from engagement with the free end portion 24 of the C-shaped hook base 14 to the open entrance, between the pivotable free end portion 18 of the pivotable latch 16 and the pivotable free end portion 24 of the C-shaped hook base 14, and allow the hook member 12 to be attached or detached from a desired component, e.g. an eyelet or a continuous loop member 66.

Once the user releases the pull ring 30 and thus discontinues tugging or pulling the actuation wire 22, the spring within the hook member 12 biases the pivotable latch member 16 to return the pivotable latch member 16 back into its normally closed orientation and close the entrance. It is to be appreciated that the spring must be stiff enough to return not only the pivotable latch member 16 but also the actuation wire 22 and the pull ring 30 back to their initial orientations as can be seen in FIG. 1. Such return action of the pivotable latch member 16 facilitates retention of a desired component by the device 1.

Figure 2:
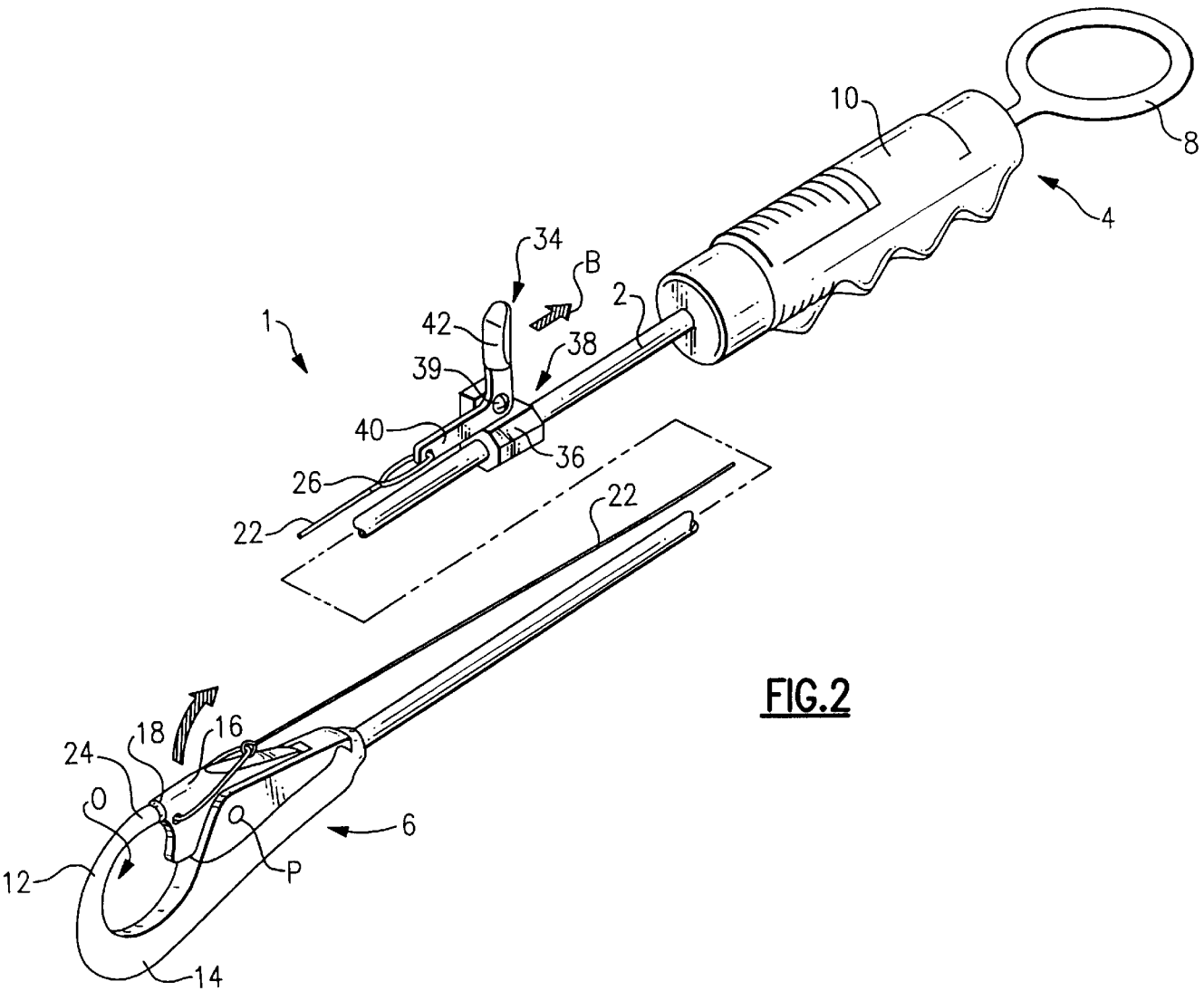
FIG. 2 is a diagrammatic prospective view showing a second embodiment of the device according to the present invention.

With reference now to FIG. 2, a detailed description concerning a second embodiment of the present invention will now be described. As this embodiment is very similar to the first embodiment, only the differences between the second embodiment, in comparison to the first embodiment, will be discussed in detail. It is to be appreciated that identical elements are designated with identical reference numerals and a further detail description concerning those previously discussed elements is not provided.

As can be seen in this Figure, the major difference is the replacement of the pull ring 30, of the first embodiment, by a pivotable right angle lever member 34 which is secured to the elongate shaft 2 by a lever support 36. The lever support 36 is permanently attached, designated by reference numeral 38, to the elongate shaft 2 by either bolts, welding or otherwise secured to the elongate shaft 2, adjacent the hand grip 10, by some other conventional manner. The right angle lever member 34 is pivotably supported by the lever support 36 via a pivot pin 39. The right angle lever member 34 has a first leg 40 extending substantially parallel to the shaft 2 which is coupled, e.g. tied, to the second end 26 of the actuation wire 22, while a second leg 42 thereof extends substantially at a right angle to the first leg 40 to facilitate actuation of the right angle lever member 34. Preferably, at least a tip portion of the second leg is inclined at a slight angle with respect to the elongate shaft 2, e.g. an angle of about 15–40 degrees or so, to facilitate operation by a user's thumb or fingers.

According to this embodiment, when the user actuates the second leg 42 of the right angle lever member 34, in the direction of arrow B, this causes the right angle lever member 34 to pivot clockwise (as can be seen in FIG. 2) and tension the actuation wire 22. This generated tension force is conveyed by the actuation wire 22 to the pivotable latch 16 to bias the free end 18 of the pivotable latch member 16 outwardly out of engagement with the free end portion 24 of the C-shaped hook base 14 to open the entrance, between the pivotable free end portion 18 of the pivotable latch 16 and the pivotable free end portion 24 of the C-shaped hook base 14, and allow the hook member 12 to be attached or detached from a desired component, e.g. an eyelet or continuous loop member.

Once the user releases the right angle lever member 34, the spring within the hook member 12 biases the pivotable latch member 16 to return the pivotable latch member 16 back into its normally closed orientation and close the entrance. Such return action of the pivotable latch member 16 facilitates retention of a desired component to the device 1. It is to be appreciated that the spring must be stiff enough to return not only the pivotable latch member 16 but also the actuation wire 22 and the right angle lever member 34 back to their initial orientations, as can be seen in FIG. 2.

Figure 3:
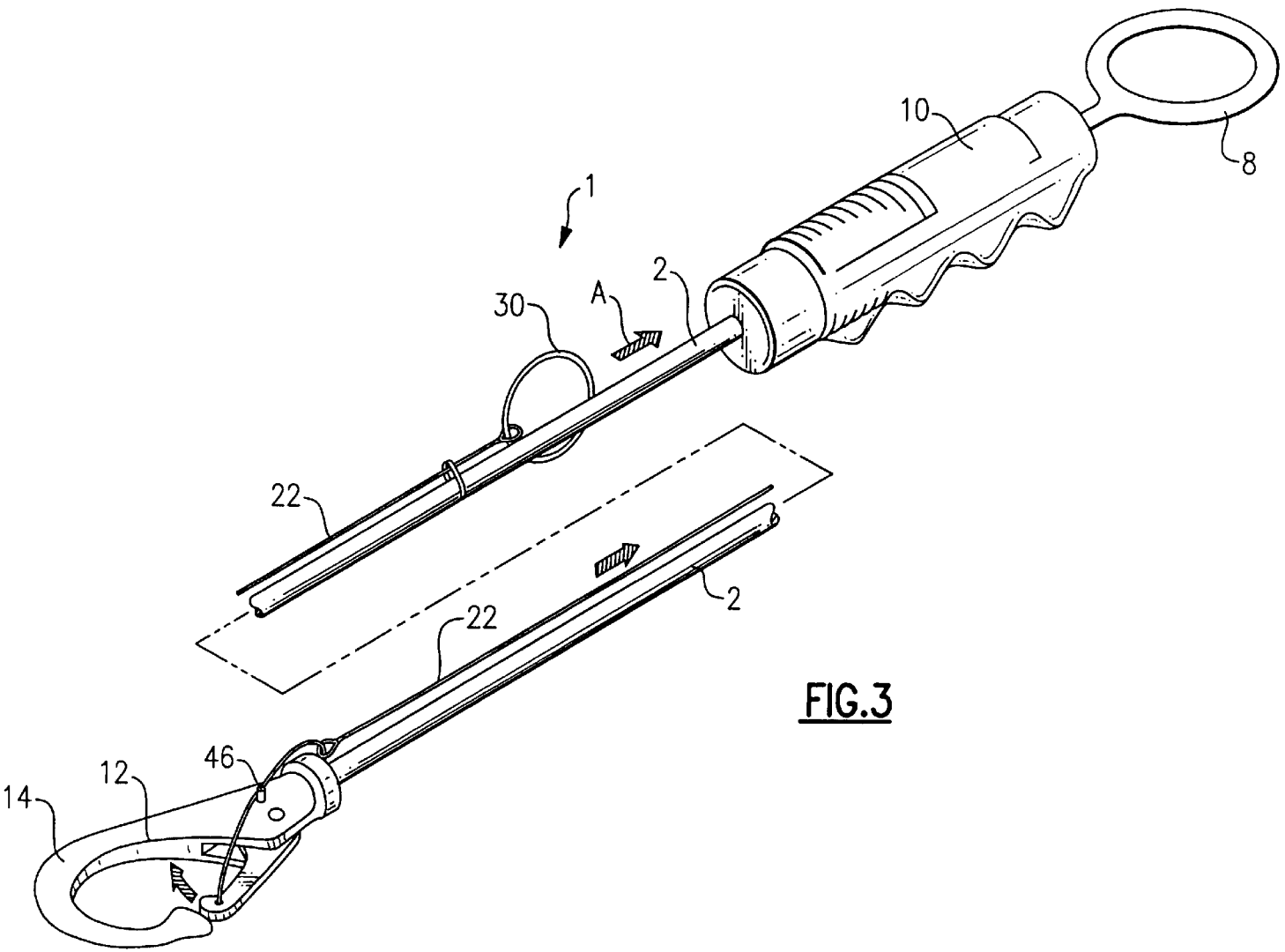
FIG. 3 is a diagrammatic prospective view showing a third embodiment of the device according to the present invention.

With reference now to FIG. 3, a detailed description concerning a third embodiment of the present invention will now be described. As this embodiment is very similar to the first embodiment, only the differences between the third embodiment, in comparison to the first embodiment, will be discussed in detail. It is to be appreciated that identical elements are designated with identical reference numerals and a further detail description concerning those previously discussed elements is not provided.

The major difference between this embodiment and the first embodiment is the rotational movement of the pivotable latch 16. According to this embodiment, the pivotable latch member 16 has a either tension or a compression spring (not shown in detail) which biases the free end portion 18 of the pivotable latch member 16 into its normally closed position engaging with the free end portion 24 of the C-shaped hook base 14. The spring is located within the hook member 12, between the pivotable latch member 16 and the C-shaped hook base 14, adjacent the pivot P to bias the pivotable latch member 16 into its closed position. Although the first end 20 of the actuation wire 22 is coupled to the free end portion 18 of the pivotable latch member 16, as with the first embodiment, the actuation wire 22 is guided around a pair of guide surfaces or pins 46 extending perpendicularly from opposed sides of the hook base 14, before extending rearwardly toward the pull ring 30. The guide pins 46 act as guide surfaces and facilitate transferring the pulling or tugging force of the actuation wire 22 to the pivotable latch member 16 to draw the pivotable latch member 16 inwardly toward the C-shaped hook base 14 and thereby open the entrance and facilitate attachment and detachment of the hook member 12 to and from a desired component. In all other respects, this embodiment is substantially identical to the first embodiment.

Figure 4:
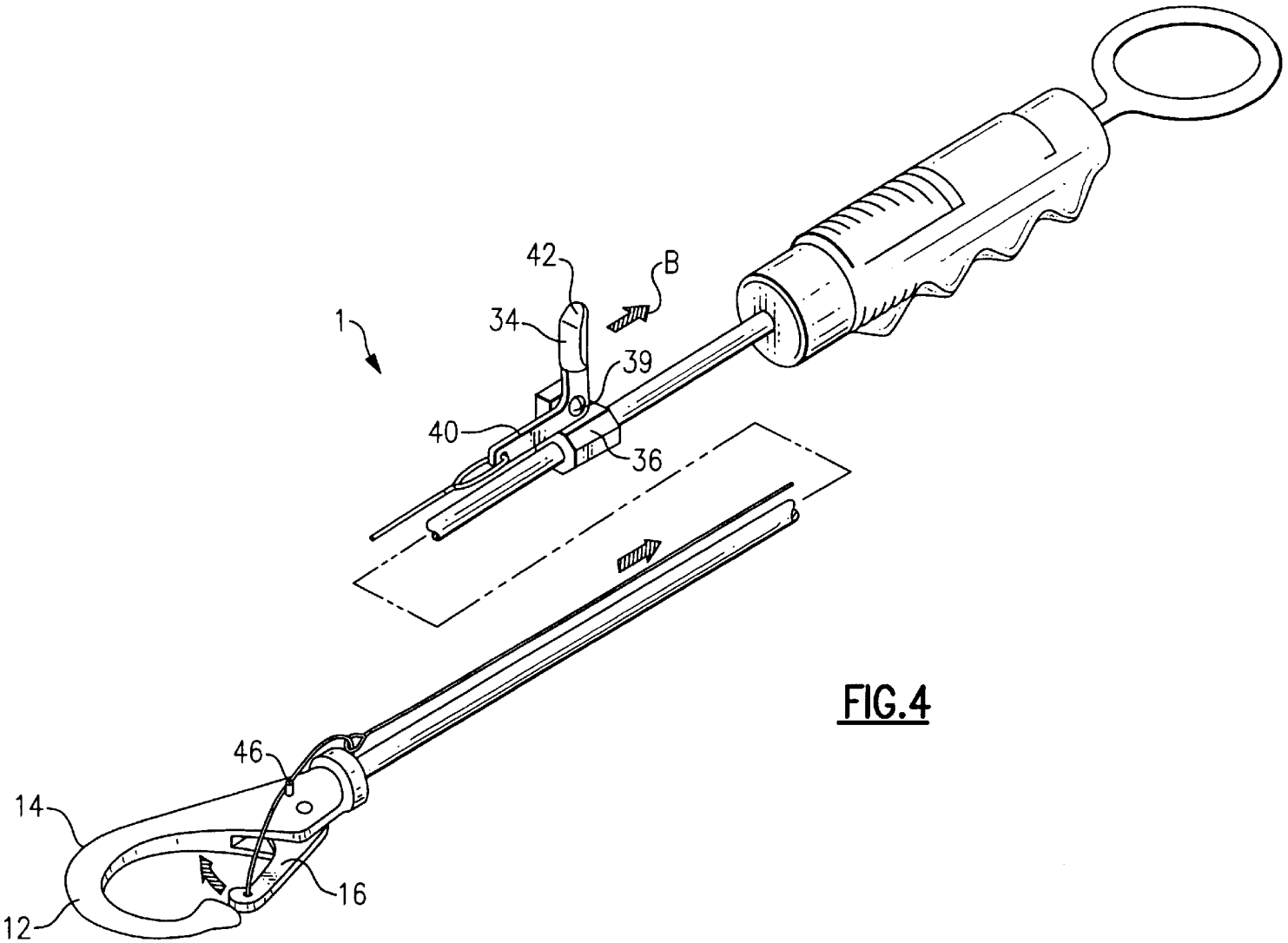
FIG. 4 is a diagrammatic prospective view showing a fourth embodiment of the device according to the present invention.

With reference now to FIG. 4, a detailed description concerning a fourth embodiment of the present invention will now be described. As this embodiment is very similar to both the second and the third embodiments, this embodiment will only be briefly discussed. It is to be appreciated that as identical elements are designated with identical reference numerals, no further detail description concerning the previously described elements is provided.

The device 1, according to this embodiment, incorporates the hook member 12 arrangement, of the embodiment of FIG. 3, and the pivotable right angle lever member 34 and lever support 36 arrangement, of the embodiment of FIG. 2. The pivotable latch member 16 is biased clockwise, by either a tension or compression spring (not shown in detail) housed within the hook member 12, so that the free end portion 18 of the pivotable latch member 16 engages with the free end portion 24 of the C-shaped hook base 14 and normally closes the entrance. As with the third embodiment, the actuation wire 22 is guided around a pair of guide surfaces or pins 46 extending perpendicularly from opposed sides of the hook base 14, before extending rearwardly toward the right angle lever support 36. The guide pins 46 act as guide surfaces and facilitate transferring the pulling or tugging force of the actuation wire 22 to the pivotable latch member 16 to draw the pivotable latch member 16 inwardly toward the C-shaped hook base 14 and thereby open the entrance and facilitate attachment and detachment of the hook member 12 to and from a desired component.

The right angle lever support 36 is permanently attached, designated by reference numeral 38, to the elongate shaft 2 by either bolts, welding or otherwise secured to the elongate shaft 2, adjacent the hand grip 10, by some other conventional manner. The right angle lever member 34 is pivotably supported by the lever support 36 via a pivot pin 39. The right angle lever member 34 has a first leg 40 extending substantially parallel to the shaft 2 which is coupled, e.g. tied, to the second end 26 of the actuation wire 22, while a second leg 42 thereof extends substantially at a right angle to the first leg 40 to facilitate actuation of the right angle lever member 34. Preferably, at least a tip portion of the second leg is inclined at a slight angle with respect to the elongate shaft 2, e.g. an angle of about 15–40 degrees or so, to facilitate operation by a user's thumb or fingers.

When the user actuates the second leg 42 of the right angle lever member 34, in the direction of arrow B, this causes the right angle lever member 34 to pivot clockwise (as can be seen in FIG. 4) and tension the actuation wire 22. This generated tension force is conveyed by the actuation wire 22 to the pivotable latch 16 to bias the free end 18 of the pivotable latch member 16 inwardly out of engagement with the free end portion 24 of the C-shaped hook base 14 to open the entrance, between the pivotable free end portion 18 of the pivotable latch 16 and the pivotable free end portion 24 of the C-shaped hook base 14, and allow the hook member 12 to be attached or detached from a desired component, e.g. an eyelet or continuous loop member.

Now that all four embodiments have been discussed in detail, a detailed description concerning use of all four embodiments of the device 1, according to the present invention, will now be provided. The device 1, according to the present invention, is typically permanently coupled via its eyelet or continuous loop member 8 to a mooring buoy 50 of a mooring 52. Typically the loop member 8 is coupled to a lower loop member 54 of the mooring 52 via a conventional first flexible linkage 56 such as a marine rope, a stainless steel chain or any other conventional marine securing member. The lower eyelet or loop member 54 of the mooring 52 is also permanently attached, via a conventional second flexible linkage 58 such as a marine rope, a stainless steel chain or any other conventional marine securing member, to a submerged weight 60 located on the bottom 62 of a lake, a river, a pond, an ocean or some other body of water 64. The submerged weight 60 is suitably sized to retain the mooring 52 and any coupled boat at its installed location.

The weight 60 is typically embedded, sunken or submerged into the bottom 62 of the body of water 64 so that the weight 60 is essentially permanently affixed at the submerged location. As mooring buoy 50 is buoyant, it floats on the top surface of the body of water 64 and is coupled to the weight 60 by the conventional second flexible linkage 58. Such coupling and floatation facilitates positioning of an upper eyelet or loop member 66 out of the body of water 64 to facilitate both coupling and uncoupling with the hook member 12 of the device 1. As the general features of the boat mooring are conventional and well known in the art, and form no part of the present invention per se, a further detailed discussion concerning the same is not provided.

During normal use, the hook member 12 of the device 1 is initially hooked to the upper eyelet or loop member 66, supported by the mooring 52, so that the hand grip 10 may be partially submerged under the water 64 As the device 1, according to the present, is manufactured from stainless steel, or some other material resistant to rust and corrosion, use in water or salt water is not problematic.

When a user desires to moor a boat, the user guides the boat and approaches the mooring 52 so that the user can retrieve the partially submerged device 1 from the water 64 (see FIG. 5) either by hand or by using a paddle, hook or some other conventional retrieval element. Once the device 1 is retrieved, the user will grab the hand grip 10 and operate the actuating mechanism, e.g. either the pull ring 30 or the right angle lever member 34 or some other conventional actuation member, to bias the pivotable latch member 16, via the actuation wire 22, into an open position, i.e either inwardly or outwardly depending on the above described embodiment, away from the free end portion 24 of the C-shaped hook base 14 to facilitate detachment of the hook member 12 from the upper eyelet or loop member 66 of the mooring 52. Thereafter, the user, while still retaining the pivotable latch 16 in its open position, can easily secure the hook member 12 to an eyelet 68 generally located at the bow of the boat 70. Once this has occurred, the user releases the attachment member and the hook member 12 is permanently affixed to the eyelet 68 at the bow of the boat and thereby couples the boat to the mooring 52. Thereafter, the user can disembark the boat in a conventional manner.

When use of the boat 70 is desired, the user retrieves the device 1 from the water 64 by hand or using a paddle, a hook or some other conventional retrieval component. Once the device 1 is retrieved, the user will grasp the hand grip 10 and operate the actuating mechanism, e.g. either the ring 30 or the right angle lever member 34 or some other conventional actuation member, to bias the pivotable latch member 16, via the actuation wire 22, either inwardly or outwardly into its open position away from the free end portion 24 of the C-shaped hook base 14 to facilitate detachment of the hook member 12 from the eyelet 68 of the boat 70. Thereafter, the user, while still retaining the pivotable latch 16 in its open position, can hook the hook member 12 to the eyelet 66 of the mooring 52. Once this has occurred, the user releases the actuating mechanism and the hook member 12 is affixed to the upper eyelet or loop member 66, supported by the mooring 52. Due to the floatation of the mooring buoy 50, the device 1 is maintained close to the top surface of the water 64 for easy retrieval by the end user once boating activity is concluded.

Preferably the elongate shaft has an axial length of between at least two (2) feet and ten (10) feet, depending on the size of the boat, and more preferably the axial length of the shaft is between about three (3) to about five (5) feet.

Since certain changes may be made in the above described improved device for coupling a boat to a mooring, without departing from the spirit and scope of the invention herein involved, it is intended that all of the subject matter of the above description or shown in the accompanying drawings shall be interpreted merely as examples illustrating the inventive concept herein and shall not be construed as limiting the invention.

Wherefore, I claim:

1. A device for coupling a boat to a mooring, the device comprising an elongate shaft having a first end and an opposed second end, the first end of the shaft having a coupling mechanism for coupling the device to a mooring, the second end of the shaft supporting a hook member comprising a generally C-shaped hook base and a free end portion, the C-shaped hook base further comprising a pivotable latch member pivotally connected therewith, the pivotable latch member being normally biased into a closed position by pivoting motion of the pivotable latch member toward both the C-shaped hook base and the free end portion so that the pivotable latch member engages with the free end portion; and an actuating mechanism having an actuator located adjacent the coupling mechanism and coupled with the pivotable latch member for pivoting the pivotable latch member away from both the C-shaped hook base and the free end portion so that the pivotable latch member disengages from the free end portion to facilitate one of coupling and uncoupling of the hook member from a desired component.

2. The device for coupling a boat to a mooring according to claim 1, wherein the coupling mechanism comprises an eyehook permanently attached to the first end of the elongate shaft and an entire length of the actuating mechanism extends parallel to the elongate shaft and along an exterior surface thereof.

3. The device for coupling a boat to a mooring according to claim 2, wherein a hand grip is positioned adjacent the eyehook to facilitate manipulation of the device by an end user and the actuating mechanism is exposed to the exterior environment while extending parallel to and along the exterior surface of the elongate shaft without passing inside the elongate shaft.

4. The device for coupling a boat to a mooring according to claim 1, wherein the C-shaped hook base defines an entrance leading to an opening, and the pivotable latch normally closes the entrance.

5. The device for coupling a boat to a mooring according to claim 4, wherein the actuation mechanism comprises a first end of an actuation wire coupled to a free end portion of the pivotable latch member to facilitate biasing the free end portion out of engagement with the free end portion of the C-shaped hook base to open the entrance and facilitate one of coupling and uncoupling of the hook member to a desired component, and an opposed second end of the actuation wire is attached to the actuator to facilitate remote actuation of the pivotable latch member.

6. The device for coupling a boat to a mooring according to claim 5, wherein the actuator is a pull ring attached to the opposed second end of the actuation wire, and the actuation wire passes through at least one guiding eyelet positioned along the exterior of the elongate shaft to facilitate grasping of the pull ring.

7. The device for coupling a boat to a mooring according to claim 5, wherein the actuator is a pivotable right angle lever member secured to the elongate shaft by a lever support, the right angle lever member is pivotable relative to the lever support via a pivot, and the right angle lever member comprises a first leg extending substantially parallel to the elongate shaft which is coupled to the second end of the actuation wire while a second leg, of the right angle lever member, extends substantially at a right angle to the first leg to facilitate actuation of the right angle lever member.

8. The device for coupling a boat to a mooring according to claim 1, wherein the elongate shaft, the hook member and the coupling mechanism are all manufactured from a corrosion resistant material;

the shaft has a length of between two (2) feet and ten (10) feet; and the shaft has a transverse cross sectional diameter of at least a ¼ of inch.

9. The device for coupling a boat to a mooring according to claim 1, wherein a spring biases the pivotable latch member of the hook member into its normally closed position.

10. A device for coupling a boat to a mooring, the device comprising an elongate shaft having a first end and an opposed second end, the first end of the shaft having a coupling mechanism for coupling the device to a mooring, the second end of the shaft supporting a hook member comprising a generally C-shaped hook base and a free end portion, the C-shaped hook based further comprising a pivotable latch member pivotally connected therewidth, a pivotable latch member being normally biased into a closed position by pivoting motion of the pivotable latch member toward both the C-shaped hook base and the free end portion so that the pivotable latch member engages with the free end portion;

an actuating mechanism having an actuator located adjacent the coupling mechanism and coupled with the pivotable latch member for pivoting the pivotable latch member away from both the C-shaped hook base and the free end portion so that the pivotable latch member disengages from the free end portion to facilitate one of coupling and uncoupling of the hook member from a desired component;

the coupling mechanism comprises an eyehook permanently attached to the first end of the elongate shaft and an entire length of the actuating mechanism extends substantially parallel to the elongate shaft and along an exterior surface thereof;

a hand grip is positioned adjacent the eyehook to facilitate manipulation of the device by an end user and the actuating mechanism is exposed to the exterior environment while extending parallel to and along an exterior surface of the elongate shaft without passing inside the elongate shaft;

the C-shaped hook base defines an entrance leading to an opening, and the pivotable latch normally closes the entrance; and the actuation mechanism comprises a first end of an actuation wire coupled to a free end portion of the pivotable latch member to facilitate biasing the free end portion out of engagement with the free end portion of the C-shaped hook base to open the entrance and facilitate one of coupling and uncoupling of the hook member to a desired component, and an opposed second end of the actuation wire is attached to the actuator to facilitate remote actuation of the pivotable latch member.

11. The device for coupling a boat to a mooring according to claim 10, wherein the elongate shaft, the hook member and the coupling mechanism are all manufactured from a corrosion resistant material;

the shaft has a length of between three (3) feet and five (5) feet; and the shaft has a transverse cross sectional diameter of between about ⅜ to about ½ of an inch.

12. A boat mooring for a boat, the boat mooring comprising a device for coupling a boat to a mooring:

the device comprising an elongate shaft having a first end and an opposed second end, the first end of the shaft having a coupling mechanism for coupling the device to a mooring, the second end of the shaft supporting a hook member comprising a generally C-shaped hook base and a free end portion, the C-shaped hook base further comprising a pivotable latch member pivotally connected therewith, the pivotable latch member being normally biased into a closed position by pivoting motion of the pivotable latch member toward both the C-shaped hook base and the free end portion so that the pivotable latch member engages with the free end portion; and an actuating mechanism having an actuator located adjacent the coupling mechanism and coupled with the pivotable latch member for pivoting the pivotable latch member away from both the C-shaped hook base and the free end portion so that the pivotable latch member disengages from the free end portion to facilitate one of coupling and uncoupling of the hook member from a desired component;

a weight for engagement with a bottom of a body of water;

a floatable mooring for marking a location of the boat mooring;

a second flexible linkage for interconnecting the floatable mooring with the weight; and a first flexible linkage for interconnecting the floatable mooring with the coupling mechanism of the device.

13. The boat mooring for a boat according to claim 12, wherein the coupling mechanism comprises an eyehook permanently attached to the first end of the elongate shaft and an entire length of the actuating mechanism extends parallel to the elongate shaft and along an exterior surface thereof.

14. The boat mooring for a boat according to claim 13, wherein a hand grip is positioned adjacent the eyehook to facilitate manipulation of the device by an end user and the actuating mechanism is exposed to the exterior environment while extending parallel to and along the exterior surface of the elongate shaft without passing inside the elongate shaft.

15. The boat mooring for a boat according to claim 12, wherein the C-shaped hook base defines an entrance leading to an opening, and the pivotable latch normally closes the entrance.

16. The boat mooring for a boat according to claim 15, wherein the actuation mechanism comprises a first end of an actuation wire coupled to a free end portion of the pivotable latch to facilitate biasing the free end portion out of engagement with the free end portion of the C-shaped hook base to open the entrance and facilitate one of coupling and uncoupling of the hook member to a desired component, and an opposed second end of the actuation wire is attached to the actuator to facilitate remote actuation of the pivotable latch.

17. The boat mooring for a boat according to claim 16, wherein the actuator is a pull ring attached to the opposed second end of the actuation wire, and the actuation wire passes through at least one guiding eyelet positioned along the shaft to facilitate grasping of the pull ring.

18. The boat mooring for a boat according to claim 16, wherein the actuator is a pivotable right angle lever member secured to the shaft by a lever support, the right angle lever member is pivotable relative to the lever support via a pivot, and the right angle lever member comprises a first leg extending substantially parallel to the shaft which is coupled to the second end of the actuation wire while a second leg, of the right angle lever member, extends substantially at a right angle to the first leg to facilitate actuation of the right angle lever member.

19. The boat mooring for a boat according to claim 12, wherein the elongate shaft, the hook member and the coupling mechanism are all manufactured from a corrosion resistant material;

the shaft has a length of between two (2) feet and ten (10) feet; and the shaft has a transverse cross sectional diameter of at least a ¼ of inch.

20. The boat mooring for a boat according to claim 12, wherein a spring biases the pivotable latch member of the hook member into its normally closed position.

* * * * *